US006735871B1

(12) United States Patent
Todd-Russell

(10) Patent No.: US 6,735,871 B1
(45) Date of Patent: May 18, 2004

(54) ELECTRICALLY HEATED SCISSORS

(76) Inventor: Sammie Jean Todd-Russell, 2748 N. 44th St., Milwaukee, WI (US) 53210

( * ) Notice: Subject to any disclaimer, the term of this patent is extended or adjusted under 35 U.S.C. 154(b) by 31 days.

(21) Appl. No.: 10/191,257

(22) Filed: Jul. 8, 2002

(51) Int. Cl.[7] ..... B26B 13/00
(52) U.S. Cl. ..... 30/140
(58) Field of Search ..... 30/140; 219/227, 219/240, 241

(56) References Cited

U.S. PATENT DOCUMENTS 1,083,386 A * 1/1914 Chapman
2,863,036 A * 12/1958 Mitchell
3,892,024 A * 7/1975 Van Zyl
5,046,251 A 9/1991 Scott ..... 30/140
5,309,640 A * 5/1994 Caron ..... 30/140
5,540,685 A * 7/1996 Parins et al.
5,743,017 A * 4/1998 Dreher et al.
5,766,166 A * 6/1998 Hooven
5,908,420 A * 6/1999 Parins et al.
5,951,549 A * 9/1999 Richardson et al.
6,060,695 A * 5/2000 Härle et al.

* cited by examiner

*Primary Examiner*—Douglas D. Watts
(74) *Attorney, Agent, or Firm*—John D. Gugliotta

(57) ABSTRACT

A pair of scissors is provided having a heated cutting plate in thermal communication with a first scissor half and defining a first sharp edge and a a non-heated cutting plate overlapped by the heated cutting plate and forming a said second sharp edge. The pivoting of the heated cutting plate and the said non-heated cutting plate forms a cutting action similar to that found on an otherwise conventional pair of scissors

6 Claims, 3 Drawing Sheets

ELECTRICALLY HEATED SCISSORS

RELATED APPLICATIONS

The present invention was first described in Disclosure Document Registration 483,348 filed on Nov. 30, 2000 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to electrically heated devices. More specifically, the present invention relates to electrically heated scissors.

2. Description of the Related Art

Personal hair styles are as unique as one's personality. In the world of hair styling, there are literally thousands of styles from which to choose. One popular style which is finding wide-ranged acceptance, especially with those of African-American heritage is that of the braided design. These styles are often worn with artificial or synthetic wigs. When braiding or setting of these wigs, any cut ends must be burned on an individual basis to seal them and prevent them from unraveling. This of course occupies a great deal of time. This same problem occurs when cutting many materials or textiles which are of an artificial nature. Heat is often necessary to make the cutting process easier or seal any frayed ends.

A search of the prior art did not disclose any patents that read directly on the claims of the instant invention; however, the following references were considered related.

The following patents disclose electrically heated scissors with two pivotally connected limbs.

U.S. Pat. No. 6,060,695 issued in the name of Harle et al.

U.S. Pat. No. 5,743,017 issued in the name of Dreher et al.

U.S. Pat. No. 5,309,640 issued in the name of Canon

U.S. Pat. No. 1,083,386 issued in the name of Chapman

The following patents describe bipolar electrosurgical scissors with metal cutting edges and shearing surfaces.

U.S. Pat. No. 5,951,549 issued in the name of Richardson et al.

U.S. Pat. No. 5,908,420 issued in the name of Parins et al.

U.S. Pat. No. 5,766,166 issued in the name of Hooven

U.S. Pat. No. 5,540,685 issued in the name of Parins et al.

U.S. Pat. No. 3,892,024 issued in the name of Van Zyl discloses a hollow knife, paint scraper, or the like for receiving a heating element.

U.S. Pat. No. 2,863,036 issued in the name of Mitchell et al. describes electrically heated butcher knives.

Consequently, there exists a need for a means by which artificial materials can be cut quickly and easily without any of the disadvantages as listed above.

SUMMARY OF THE INVENTION

It is therefore an object of the present invention to provide electrically heated scissors.

Briefly described according to one embodiment of the present invention, a pair of electrically heated scissors are provided that can function like a pair of conventional scissors. In addition, a power cord provides power to a set of heating elements located in the cutting blade portion of the invention. The heating elements are controlled by a thermostatic control which is set with a dial.

The invention operates on 120 vAC, but can also operate on 12 vDC with the use of a suitable power inverter. The invention is intended for use in cutting. synthetic or artificial hair, especially braided hair worn by African-Americans, but can be used in any application where the cutting process is aided by heating of the material being cut.

The use of the electrically heated scissors allows one to cut synthetic hair in a manner which is quick, easy and efficient.

Further, when using the electrically heated scissors with synthetic or artificial hair, it eliminates having to burn each individual hair.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
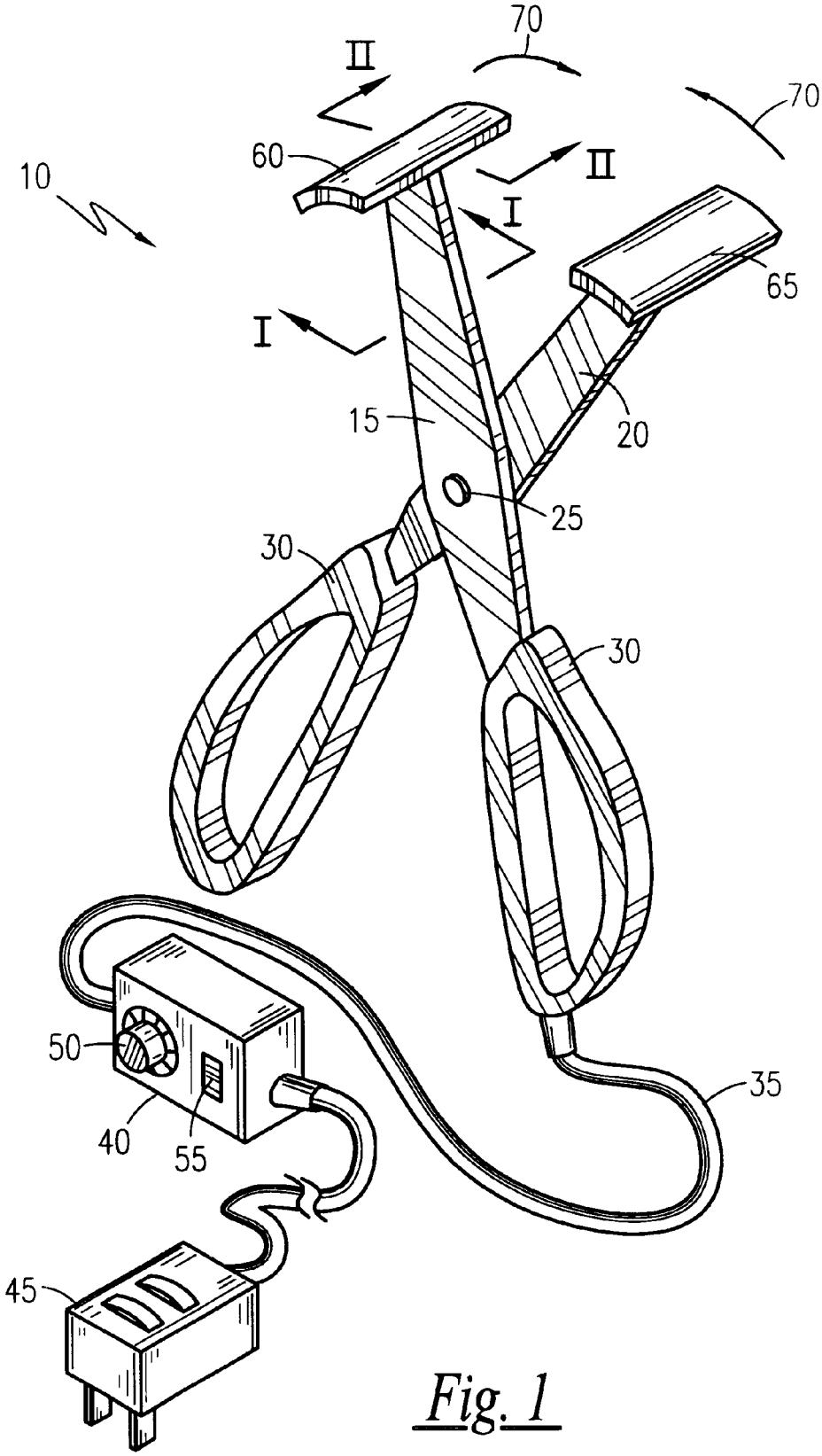
FIG. 1 is an isometric view of the electrically heated scissors 10 according to the preferred embodiment of the present invention.

Referring now to FIG. 1, an isometric view of the electrically heated scissors 10 is depicted according to the preferred embodiment of the present invention. The electrically heated scissors 10 comprise a first scissor half 15 and a second scissor half 20, as commonly found in conventional scissors, and joined together at a single point by a pivot means 25 such as a screw or a rivet. The lower handle portion of the electrically heated scissors 10 are covered with heat insulating grips 30 such as plastic to prevent the transference of heat to the user's hands. At the lowest portion of the first scissor half 15 and its heat insulating grips 30 is a power cord 35. The power cord 35 has an in-line voltage regulator 40 and an electrical plug 45 at its opposite end. The in-line voltage regulator 40 is well-known in the art and can take the form of any electrical device designed to vary the voltage applied to the electrically heated scissors 10. Examples of these include a solid-state voltage regulator, a variable transformer, a power-rated potentiometer or the like. As such, the in-line voltage regulator 40 is general in nature, and is not intended to be a limiting factor of the present invention. The in-line voltage regulator 40 has a temperature adjustment control 50 and temperature level indicator 55 which are utilized by the user to select temperature levels envisioned to be OFF, LOW, MEDIUM and HIGH. At the top of the first scissor half 15 is a heated cutting plate 60. At the top of the second scissor half 20 is a non-heated cutting plate 65. When a user squeezes the heat insulating grips 30 together, as in a manner normally associated with conventional scissors, the heated cutting plate 60 and the non-heated cutting plate 65 come together as defined by a first conductor 70. The non-heated cutting plate 65 will overlap the heated cutting plate 60 when fully closed, as will be seen herein below.

Figure 2A:
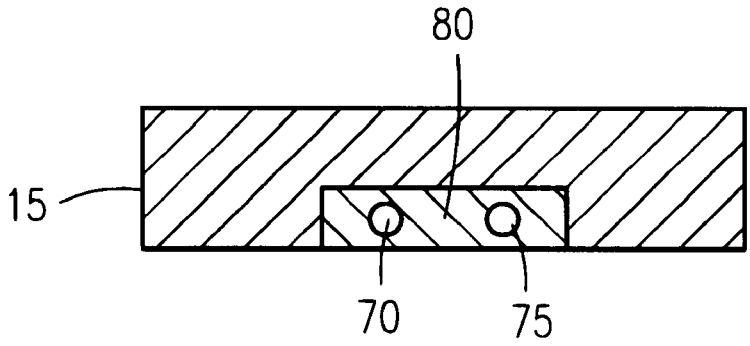
FIG. 2*a* is a sectional view of the electrically heated scissors 10, as taken along a line I—I, as seen in FIG. 1.

Referring next to FIG. 2*a*, a sectional view of the electrically heated scissors 10, as seen along a line I—I in FIG. 1, is disclosed. As electrical power must be routed from the power cord 35 to the heated cutting plate 60, as seen in FIG. 1, a first conductor 70 and a second conductor 75 routed with the first scissor half 15 are provided. The first conductor 70 and the second conductor 75 are held captive by a securing means 80 such as epoxy, adhesive or the like. Such positioning of the first conductor 70 and the second conductor 75 ensure that they will not be damaged during use of the electrically heated scissors 10.

Figure 2B:
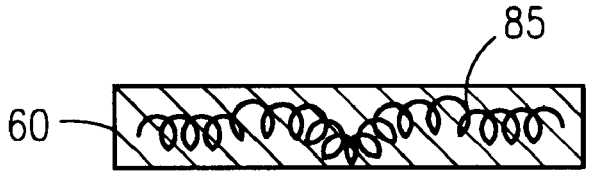
FIG. 2*b* is a sectional view of the electrically heated scissors 10, as taken along a line II—II, as seen in FIG. 1.

Referring now to FIG. 2*b*, a sectional view of the electrically heated scissors 10, as seen along a line II—II in FIG. 1, is disclosed. The heated cutting plate 60 has an internal heating coil 85 provided as shown. The connection points of the internal heating coil 85 are connected to the first conductor 70 and the second conductor 75 (as shown in FIG. 2*a*). While the operating temperature of the internal heating coil 85 can vary as set by the user with the temperature adjustment control 50 (as shown in FIG. 1), it is envisioned that the operating temperature will vary from 200 degrees Fahrenheit to 500 degrees Fahrenheit depending on the material being cut. While a high enough temperature is needed to seal open ends and fibers, too high of a temperature could result in burning or scorching of the material, or perhaps even ignition.

Figure 3:
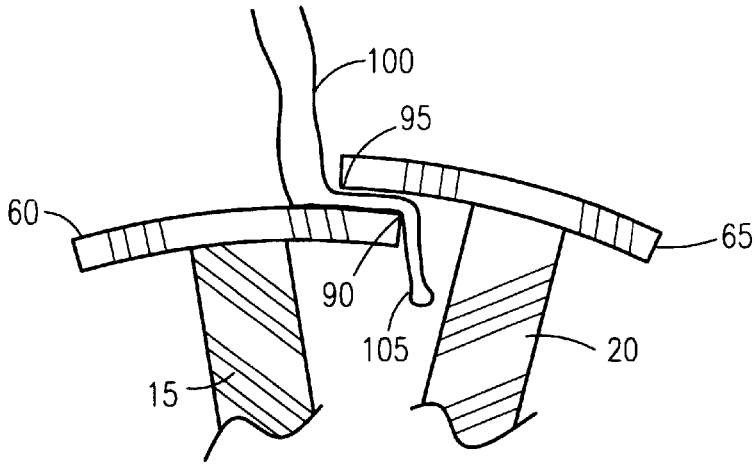
FIG. 3 is a partial elevational view of the electrically heated scissors 10 shown in an utilized state.

Referring next to FIG. 3, a partial elevational view of the electrically heated scissors 10 shown in an utilized state is depicted. The heated cutting plate 60 is overlapped by the non-heated cutting plate 65 and form a cutting action as defined by a first sharp edge 90 and a second sharp edge 95 respectively. Such action is similar to that found on a conventional pair of scissors. A section of cutting material 100, such as braided human hair, nylon webbing, synthetic rope, or any material subject to unraveling when cut is shown. As the cutting action of the first sharp edge 90 and the second sharp edge 95 commences, the hot surface of the heated cutting plate 60 initially aids in the cutting action. Then as the cutting action nears its completion, the non-heated cutting plate 65 pushes the cutting material 100 across the hot surface of the heated cutting plate 60 as shown to fuse any loose fibers together, thus preventing future unraveling of the cutting material 100. Such cutting action produces a discard piece 105 which is simply discarded.

Figure 4:
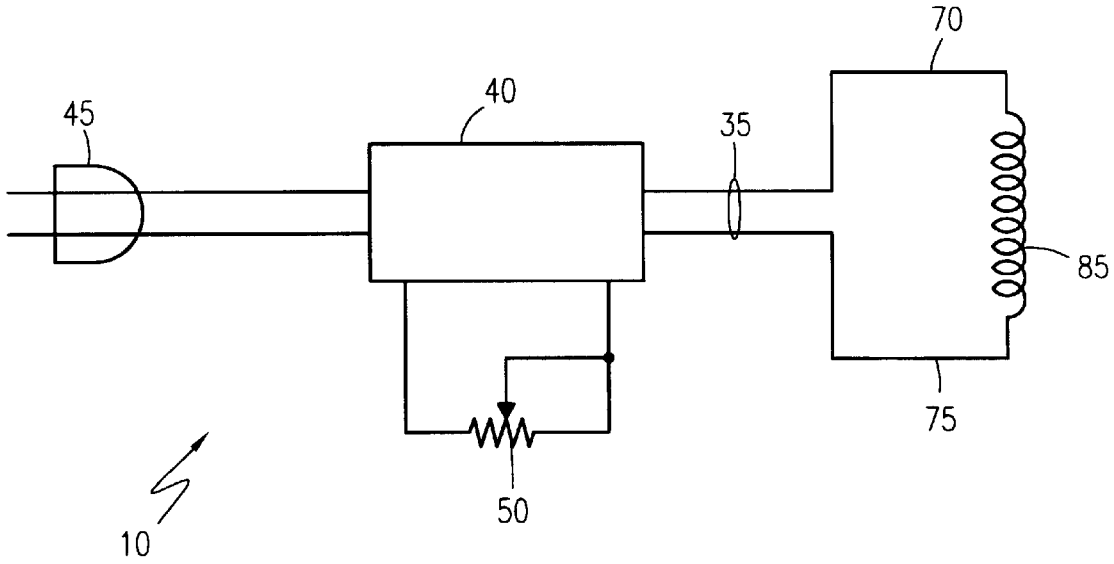
FIG. 4 is an electrical schematic diagram of the electrically heated scissors 10.

Referring finally to FIG. 4, an electrical schematic of the electrically heated scissors 10 is shown. Power from the electrical plug 45 is routed to the in-line voltage regulator 40 which produces a reduced voltage waveform at its output as controlled by the temperature adjustment control 50. This power is routed in the power cord 35 and its associated first conductor 70 and second conductor 75 to the internal heating coil 85. This arrangement is well-known in the art and is commonly associated with curling irons, heating pads, electric blankets and the like.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The present invention is designed with ease of operation features in mind that allow it to be utilized by a common user with little or no training or experience in a transparent manner. After acquisition of the electrically heated scissors 10, it is connected to a suitable power source, envisioned to be 120 volts alternating current, with the use of the electrical plug 45. Next, a suitable temperature level, dependent on the material being cut, is selected with the aid of the temperature adjustment control 50 and the temperature level indicator 55. After a suitable warm-up period, envisioned to be approximately 15–25 minutes, the electrically heated scissors 10 is ready for use.

To perform actual cutting operations with the electrically heated scissors the user would grasp the electrically heated scissors 10 in a manner identical to that of a conventional pair of scissors. Then, while firmly holding the cutting material 100, the user simply squeezes the first scissor half 15 and the second scissor half 20 together, thus forcing the heated cutting plate 60 and the non-heated cutting plate 65 together at the desired cutting point. As the first sharp edge 90 and the second sharp edge 95 cut through the cutting material 100, the raw fiber ends are fused/melted together from the heat provided by the heated cutting plate 60. Upon completion of the cutting action, the electrically heated scissors 10 is simply opened back up, once again in a manner similar to that of a pair of scissors and the discard piece 105 is removed and eliminated.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. In scissors formed by a first scissor half having a first sharp edge and a second scissor half having a second sharp edge and joined together at a single point by a pivot means, wherein the improvement comprises:

a heated cutting plate formed at a terminal end of said first scissor half and extending generally parallel with the pivot axis, said heated cutting plate in thermal communication with said first scissor half and defining said first sharp edge;

thermal generating means for heating said heated cutting plate;

a non-heated cutting plate formed at a terminal end of said second scissor half, said non-heated cutting plate overlapped by said heated cutting plate and defining said second sharp edge; wherein the pivoting of said heated cutting plate and said non-heated cutting plate in a horizontal direction generates a cutting action as defined by said first sharp edge and said second sharp edge facilitating crimping, cauterizing and cutting of hair or fabric.

2. In the scissors of claim 1, wherein said improvement further comprises heat insulating grips affixed to said first scissor half and said second scissor half to prevent the transference of heat to the user's hands.

3. In the scissors of claim 1, wherein said heated cutting plate further comprises an internal heating coil in electrical communication with an electrical power cord.

4. In the scissors of claim 3, wherein said heated cutting plate further comprises a temperature adjustment control.

5. In the scissors of claim 4, wherein said temperature adjustment control comprises a voltage regulator which produces a reduced voltage waveform at its output as controlled by the temperature adjustment control.

6. In the scissors of claim 4, wherein said temperature adjustment control further comprises a temperature level indicator.

* * * * *